United States Patent [19]

Floden

[11] Patent Number: 4,943,347

[45] Date of Patent: Jul. 24, 1990

[54] METHOD OF REFINING FIBROUS MATERIAL BY CONTROLLING THE FEED RATE OF MATERIAL OR THE GAP DISTANCE BETWEEN DISCS

[76] Inventor: Mats Floden, Box 128, Taby, Sweden, S-18322

[21] Appl. No.: 410,023

[22] Filed: Sep. 20, 1989

Related U.S. Application Data

[63] Continuation of Ser. No. 306,231, Feb. 3, 1989, abandoned, which is a continuation of Ser. No. 60,052, filed as PCT SE86/00366 on Aug. 14, 1986, published as WO87/01056 on Feb. 26, 1987, abandoned.

[30] Foreign Application Priority Data

Aug. 20, 1985 [SE] Sweden ..... 8503882

[51] Int. Cl.[5] ..... D21D 5/20; D21F 7/06

[52] U.S. Cl. ..... 162/61; 162/253; 162/254; 241/28; 241/34; 241/37

[58] Field of Search ..... 162/254, 28, 253, 61; 241/33, 36, 37, 28, 34

[56] References Cited

U.S. PATENT DOCUMENTS

| | | | |
|---|---|---|---|
| 3,212,721 | 10/1965 | Asplund et al. . | |
| 3,309,031 | 3/1967 | McMahon et al. . | |
| 3,604,645 | 9/1971 | Keyes, IV . | |
| 3,604,646 | 9/1971 | Keyes, IV . | |
| 3,610,541 | 10/1969 | Gudaz . | |
| 3,617,006 | 11/1971 | Jones . | |
| 3,847,359 | 11/1974 | Holmes et al. . | |
| 4,184,204 | 1/1980 | Flohr | 162/254 |
| 4,589,598 | 5/1986 | Ellery, Sr. | 162/254 |
| 4,661,911 | 4/1987 | Ellery, Sr. | 162/254 |

FOREIGN PATENT DOCUMENTS

| | | |
|---|---|---|
| 89847 | 9/1937 | Sweden . |
| 407952 | 4/1979 | Sweden . |
| 438877 | 5/1985 | Sweden . |

OTHER PUBLICATIONS

Rogers et al; "Automatic Control of Chip Refining"; 10-1980 *Pulp and Paper Canada;* vol. 81, No. 10, pp. 89-96.

Moore "Refiner Control-Working Group Report"; 9-1979 *Paper Tech & Ind;* pp. 256-258.

Derwent's abstract No. 53 416 K/22, SU 943 316, Jul. 15, 1982.

Derwent's abstract No. 84-206522/33, SU I 063 459, Dec. 30, 1983.

*Primary Examiner*—Steve Alvo

*Attorney, Agent, or Firm*—Dowell & Dowell

[57] ABSTRACT

A method of refining fibrous material under predetermined conditions by the help of relatively rotating refining means. The material is during refining passed from the inner circumference of the refining means to their outer circumference and is thereby exposed to bending forces and axial forces. At least two variables of the refining process, such as power and gap width are measured. The measured values of the variables and their relation are used to compare them with the set point values of the predetermined refining conditions for these variables to create control signals for positioning devices for the refining means, thereby returning the refining process to the aforementioned predetermined conditions and keeping these dependent variables constantly at these conditions.

9 Claims, 2 Drawing Sheets

METHOD OF REFINING FIBROUS MATERIAL BY CONTROLLING THE FEED RATE OF MATERIAL OR THE GAP DISTANCE BETWEEN DISCS

No. 07/306,231, filed Feb. 3, 1989, now abandoned, which is a continuation of application 07/060,052 filed as PCT SE86/00366 on Aug. 14, 1986 published as W087/01056 on Feb. 26, 1987, now abandoned.

The present invention relates to a method for refining fibrous material under predetermined conditions by the help of relatively rotating refining means, the material being forced to pass from the inner circumference of the refining means to their outer circumference through gaps in the refining means and thereby being exposed to bending forces and axial forces.

To be able to obtain an even quality of the refined material during refining of fibrous material, the disturbances of the operating conditions, occurring during refining due to different reasons, must be adjusted by continuous control of the different parameters for refining to obtain the best possible values. To be able to take the necessary steps when disturbances of the operating conditions are occurring, a knowledge of what type of disturbance that is causing a change in the refining process, is called for. So far this has not been possible without using manual sampling and analysis of e.g. incoming wood or using a special automatic sampling device.

Another difficulty for the best possible refining of fibrous material consists of the features of the refiner, several independent variables to be influenced to obtain this best possible refining. These independent variables themselves influence, one by one, a number of independent variables. This means, that in keeping one of the dependent variables constant another dependent variable is influenced, this at the most occurring in a disadvantageous way to the refining process. Thus the refining process is multivariable, as it is usually called in controls. To obtain the best possible refining at least two of the dependent variables must be kept constant by the help of the control devices of the refiner. However, this creates complications by using known technique in which one is trying to obtain the best possible refining by the help of exterior transmitters.

The main object of this invention is to create a method for refining fibrous material as described above by quickly and accurately defining the type of disturbances causing a change in the refining process and by which one can quickly arrive or return to the predetermined conditions for the refining process.

This object is achieved by the method of the invention in connection with the characteristics of the adhering claims.

The method can be used e.g. in conventional grinding devices or refiners and an example of such a refiner is described in the Swedish Patent 214,707, with the necessary details of the construction and the operation of the refiner being specified.

BRIEF DESCRIPTION OF THE DRAWINGS

In the following the invention will be described in detail in connection with the drawings which show embodiments of control systems for carrying out the method.

Figure 1:
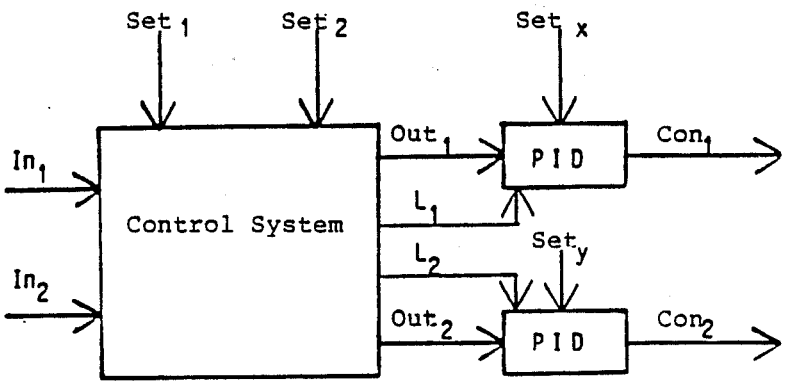
In FIG. 1 the overall structure of the controller performing the method of the invention is shown.

The overall structure of the controller according to FIG. 1 consists of a control system of two input signals In1 and In2 and two set points Set1 and Set2. The control system has output signals Out1 and Out2 as well as L1 and L2. These output signals from the control system form together with the set points SetX and SetY the input signals to the PID-controllers, independent of each other. The output signals Out1 and Out2 from these controllers actuate two different positioning devices of the refiner in which the refining process takes place. The two signals L1 and L2 are logical and decide on which of the two PID-controllers to perform the control at that actual moment. Both controllers cannot be active at the same time, but the output signals can be "frozen" in the not activated PID-controller.

The control system consists of four logical choices:

1. In1-Set1>0+−d1 & In2-Set2>0+−d2
2. In1-Set1<0+−d1 & In2-Set2<0+−d2
3. In1-Set1<0+−d1 & In2-Set2>0+−d2
4. In1-Set1>0+−d1 & In2-Set2<0+−d2, where d1 and d2 are adjustable dead bands.

The control system separates these four choices and decides, depending on which of these choices is relevant:

- the controller to be active by actuating the signals L1 and L2;
- which one of the input signals In1 and In2 to be the output signal from the control system to the PID-controller being active at that moment, i.e. which one of In1 and In2 should be the input signal to the controller;
- which one of the variables to be the set point for the PID-controller in question.

Figure 2:
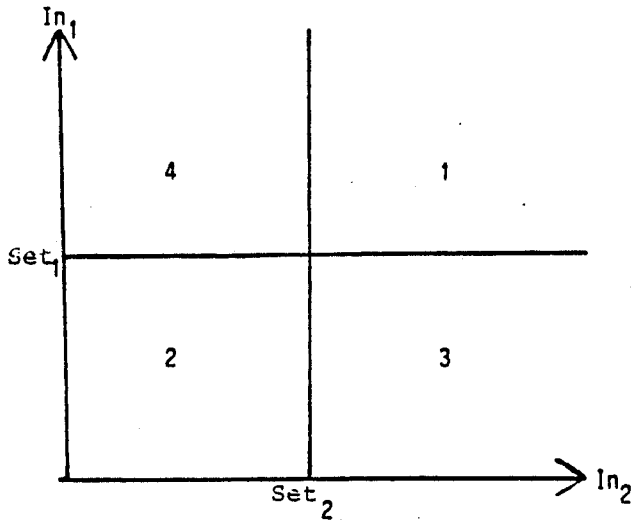
FIG. 2 is a schematic view of the distribution of the input signal in the structure of the controller in FIG. 1.

The four logical choices can also be demonstrated according to FIG. 2, the two set point values dividing the proportions of the input signals into four sectors. Thus, the control system separates these sectors in such a way that if by example both In1 and In2 are larger than the corresponding set point values a certain previously defined control operation shall be performed. This sector is represented by the rectangle (1) to the right in FIG. 1.

In this way the PID-controller being active at this moment can have different process variables for the input signal and the set point value in the four sectors, depending on which logical choice being the right one. The alternatives that possibly might occur are:

SetX=Set1 or Set2
SetY=Set1 or Set2
Out1=In1 or In2
Out2=In1 or In2

Figure 3:
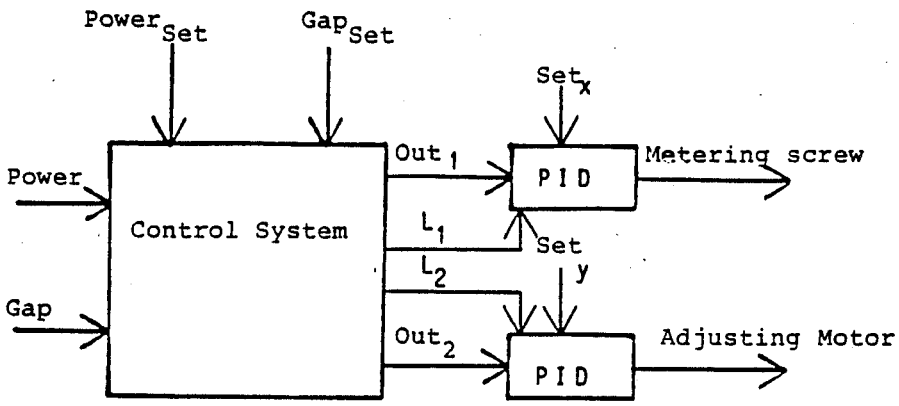
In FIG. 3 is shown a similar structure of the controller as in FIG. 1 with an example.
Figure 4:
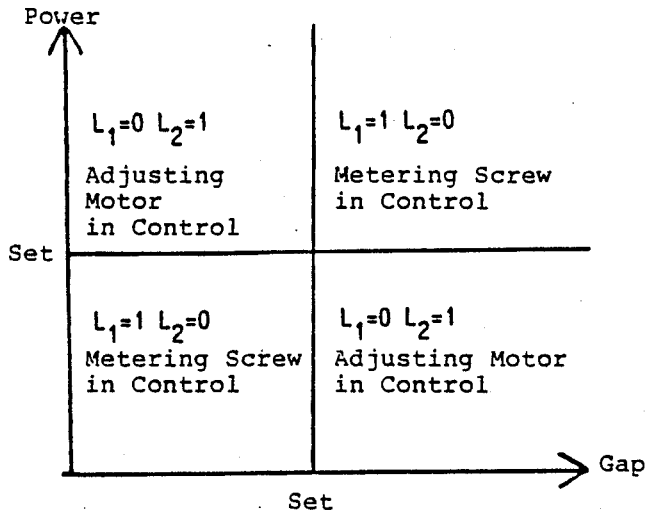
FIG. 4 shows the view of this execution as in FIG. 2.

In FIGS. 3 and 4 a special example is demonstrated, where the variables for a refining process can be chosen as follows:

In1=Power of the driving motor
In2=Gap between the refining discs
Set1=Set point value for the power
Set2=Set point value for the gap
Out1=Volume flow of the chips (rotation speed of the metering screw)
Out2=Position of the shaft unit (positioning motor).

In this way a control function according to FIG. 3 is obtained.

When the logical signals L1 and L2 are equal to 0, this implicates that the controller in question is not in operation, and if one of them (not both) is equal to 1, the controller is active.

The pairs Out1,SetX and Out2,SetY are thus related to the power or the gap. The example is defined in a way that the refiner is controlled so that the specific power applied and the gap are simultaneously kept constant. Thus different alternatives of the control to be performed in the four previously mentioned sectors can be chosen. This can be achieved in two different ways:

ALTERNATIVE 1

The set point values for the PID-controllers are chosen as follows:

SetX=Set point value for the power

SetY=Set point value for the power

The logical set up for the control measures in the different sectors is shown in FIG. 4.

Both controllers are accordingly controlling the power but using different positioning devices. The signal for the gap is here only used to detect which one of the sectors being adequate during control.

ALTERNATIVE 2

The set point values are here chosen as follows:

SetX=Set point value for the power

SetY=Set point value for the gap

The same logical set up is valid as in FIG. 4 with the difference that both PID-controllers are keeping their corresponding variable constant.

With specific reference to FIG. 4, one mode of controlling the operational variables to achieve optimum refining conditions is disclosed. As shown, when the measured value of the operational variables of the power to the driving motor and the gap distance are both greater than their respective set point values, the metering screw will be selected to be in control and is operational to reduce the flow of fibrous material until the operational variables of the power to the driving motor and the gap distance are returned to their original set point values. This operational control is reflected in the upper right hand quadrant of the graph. However, when both variables for the driving motor and gap distance are less than their respective set points then the metering screw is in control in order to adjust the flow of fibrous material until the operational variables are equal to the set point values. This is indicated in the lower left hand quadrant of the graph of FIG. 4.

In those instances where the operational variable for the power to the drive motor is greater than its respective set point value while the operational variable for the gap distance is smaller than its respective set point value, the adjusting motor is operated so as to regulate the gap distance until the measured variables are equal to their set point values. This is reflected in the upper left hand quadrant of the graph of FIG. 4. When the operational variable of the gap distance is greater than its set point value while the operational variable of the power is less than its set point, as is reflected in the lower right hand quadrant of the graph of FIG. 4, then the adjusting motor is operational to vary the gap distance until the variables are equal to their set point values.

If, according to alternative 1, the load on the driving motor is increasing, this being measured by a change in power, the input signal In1 will be changed, thus resulting in a change of Out1, the corresponding PID-controller changing the supply of material to the refining devices by changing the rotation speed of the metering screw until the predetermined refining conditions have been achieved i.e. the load on the driving motor has returned to the previous value. This also applies to a change of the gap or of the distance between the refining discs.

Sensing is performed with sensors known in the art for measuring the power of the motor and the refining gap.

It can be clearly seen that, according to the description above, one can by the refining process performed in the refiner sense which type of disturbance at the moment being is inflicting the refining process, and with the help of two dependent variables being kept constant by the positioning devices of the refiner one can quickly achieve and return to the predetermined conditions for optimal refining of the material to be grinded.

Therefore, the adding of diluting water to the flow of fibrous material may be changed when the relation of the forces and the gaps to each other and also in combination with each other indicates a change in the refining process due to reasons other than a change in the flow of fibrous material to the refining means. Also, the pressure in the casing of the refining means may be changed when the relation of the forces and the gaps to each other and also in combination with each other indicates a change in the refining process due to reasons other than a change in the flow of fibrous material to the refining means. Further, the addition of chemicals to the fibrous material flow is changed when the relation of the forces and the gaps to each other and also in combination with each other indicates a change in the refining process due to reasons other than a change in the flow of fibrous material to the refining means.

Of course, the forms of execution being shown and being described are given as examples only of the invention and changes and modifications can be carried out without inflicting the scope of this invention. Thus, more than two variables can be actuated in the way previously described by additional control devices.

I claim:

1. A method of refining fibrous material under predetermined operational conditions utilizing relatively rotating refining means which are driven by a driving motor, the material being introduced by a metering means and forced to pass through a gap between discs of the refining means and thereby being exposed to bending forces and axial forces with the flow of material being regulated by a positioning device for regulating the rate of feed of the metering means and a separate positioning device for regulating the gap between the discs of the refining means, comprising the steps of:

(a) monitoring at least two operational variables including the power to the driving motor and the gap distance between the discs of the refining means to determine a measured value for each operational variable;

(b) comparing said measured value of said at least two operational variables with each other and a predetermined set point value for each operational variable which are indicative of the setting for each operational variable when applied to refining conditions to determine if a disturbance exists relative to the predetermined operational conditions;

(c) determining based upon the comparisons which operational variable requires adjustment to eliminate the noted disturbance;

(d) emitting a control signal to independently operate one of said positioning devices so as to adjust either the rate of feed of the metering means or the gap distance between the discs to thereby reduce the disturbance and maintain the refining process within the predetermined conditions.

2. The method of claim 1 including the additional step of selectively adding deluting water to the fibrous material when a disturbance in the refining process has been determined.

3. The method of claim 1 including the additional step of selectively changing the pressure in the refining means when a disturbance in the refining process has been determined.

4. The method of claim 1 including the additional step of selectively changing the inlet pressure to the refining means when a disturbance in the refining process has been determined.

5. The method of claim 1 including the additional step of selectively adding chemicals to the fibrous material when a disturbance in the refining process has been determined.

6. The method of claim 1, wherein when the measured value of the operational variables of the power to the driving motor and gap distance are both greater than their respective set point values, the positioning device for regulating the feed rate of the metering means is operated to reduce the flow of fibrous material to the refining means to the extent that the measured value of the operational variables of the power to the driving motor and gap distance are returned to equal their set point values.

7. The method of claim 1, wherein when the measured value of the operational variables of the power to the driving motor and the gap distance are both smaller than their respective set point values, the positioning device for regulating the feed rate of the metering means is operated to increase the flow of fibrous material to the refining means to the extent that the measured value of the operational variables of the power to the driving motor and the gap distance are returned to equal their set point values.

8. The method according to claim 1, wherein when the measured value of the operational variable of the power to the driving motor is greater than its respective set point value and the measured value of the operational variable of the gap distance is smaller than its respective set point value, the positioning device for regulating the gap distance is operated to increase the gap distance to the extent that the measured value of the operational variables of the power to the driving motor or the operational variable of the gap distance is returned to its respective set point value.

9. The method according to claim 1, wherein the measured value of the operational variable of the power to the driving motor is smaller than its respective set point value and the measured value of the operational variable of the gap distance is greater than its respective set point value, said positioning device for regulating the gap distance is operated to decrease the gap distance to the extent that the measured value of the operational variable of the power to the driving motor or the measured value of the operational variable of the gap distance is returned to its respective set point value.

* * * * *